United States Patent [19]

Schenk et al.

[11] 4,331,539

[45] May 25, 1982

[54] PURIFICATION OF REGENERATED SIZING LIQUORS

[75] Inventors: Wolfgang Schenk, Plankstadt; Wilfried Kothe, Ludwigshafen; Karl H. Popp, Frankenthal, all of Fed. Rep. of Germany

[73] Assignee: BASF Aktiengesellschaft, Ludwigshafen, Fed. Rep. of Germany

[21] Appl. No.: 242,303

[22] Filed: Mar. 10, 1981

[30] Foreign Application Priority Data

Apr. 11, 1980 [DE] Fed. Rep. of Germany ..... 3013925

[51] Int. Cl.[3] ..... C02F 3/02

[52] U.S. Cl. ..... 210/620; 162/4; 162/189

[58] Field of Search ..... 210/620, 621, 622, 626, 210/627, 628, 631, 721, 722, 601; 162/1, 4, 14, 100, 189

[56] References Cited

U.S. PATENT DOCUMENTS

| | | | |
|---|---|---|---|
| 2,865,853 | 12/1958 | Batdorf | 210/620 |
| 3,354,082 | 11/1967 | Dubach | 210/626 |
| 3,926,796 | 12/1975 | Fujita | 210/626 |

FOREIGN PATENT DOCUMENTS

| | | | |
|---|---|---|---|
| 137922 | 3/1979 | Fed. Rep. of Germany | 210/628 |
| 49-43871 | 4/1974 | Japan | 210/721 |
| 5036869 | 9/1977 | Japan | 210/620 |
| 295737 | 12/1969 | U.S.S.R. | 210/620 |

*Primary Examiner*—Ernest G. Therkorn
*Attorney, Agent, or Firm*—Oblon, Fisher, Spivak, McClelland & Maier

[57] ABSTRACT

A method of processing regenerated liquors of polyacrylate, polyvinyl alcohol and carboxymethylcellulose (CMC) sizes for reuse, wherein the impurities are substantially removed, without noticeably changing the properties of the size, by constantly aerating the liquor and separating off the precipitate thereby formed.

3 Claims, No Drawings

PURIFICATION OF REGENERATED SIZING LIQUORS

The present invention relates to a method for processing regenerated liquids of polyacrylate, polyvinyl alcohol and carboxymethylcellulose (CMC) sizes for reuse, wherein the impurities are substantially removed, without noticeably changing the properties of the size, by constantly aerating the liquor and separating off the precipitate thereby formed.

Warp yarns are sized so as to enable them better to withstand the strains of weaving. The sizes used are in the main vegetable starch, in its natural or chemically modified form, as well as polyacrylates, carboxymethylcellulose and polyvinyl alcohol. As a rule, the fabric from the loom must be desized to allow subsequent treatments such as bleaching, dyeing, printing or finishing to be carried out. The desizing liquor, which contains the size washed off the fabric, together with other substances, hereafter referred to as impurities (for example lubricants of synthetic fibers, sizing fats, singeing dust, natural constituents of cotton, such as waxes, pectins and the like, and desizing agents) has hitherto in most cases been entirely or partially discarded, and substantially pollutes the effluent. For the last-mentioned reasons, and for reasons of economy, endeavors are increasingly being made to reutilize the washed-off size, ie. to re-employ the desizing liquor, as a regenerated liquor, for sizing. This first of all presents problems concerning the concentration of the sizes in the liquor, with which problems the present invention is not concerned. Secondly, there are problems because the impurities washed off the fibers during desizing progressively accumulate with each reuse cycle of the liquor. Thirdly, the desizing liquors or regenerated liquors are not stable on storage. After a few days, they acquire such an unpleasant odor that workers cannot be expected to reuse the material. The present invention is concerned with the two last-mentioned problems.

The problem of accumulation of impurities becomes ever more important as the yield of the process of recovery of water-soluble sizes increases through improved techniques. As long as part of the desizing liquor is discarded and the size thereby lost is replaced by fresh size, the level of impurities settles at a certain figure which may still be tolerable. The problem only manifests itself with full severity when the size washed off the fabric is reused more or less completely. The sole previously known and practised answer to the problem is ultrafiltration, but this requires expensive equipment and consumes much energy.

Odor formation has hitherto been suppressed by keeping the regenerated liquor hot (which consumes much energy), or by using bactericides, ie. foreign substances which may interfere.

It is an object of the present invention to provide a simple and economical process which solves both the last-mentioned problems simultaneously, at least for some of the conventional sizes, namely those which are difficult to biodegrade.

We have found that this and other objects are achieved by the process defined in the claims.

The desizing, which can be carried out by any desired method, is not a feature of the present invention. However, a condition for the reuse of sizes and hence for the process according to the invention is that no desizing agent has been used.

The liquor can be aerated in any desired manner. All measures which bring the liquor into thorough contact with air are suitable, for example vigorous stirring, circulatory pumping with fall of the liquor through air, or trickling of the liquor over surfaces, or, preferably, passing air under the surface of the liquor. The latter can be effected in any desired manner and thus does not require any nozzles, frits or other expenditure on apparatus. It suffices to use a pipe or tube dipping into the liquor. However, a certain amount of mixing of the liquor, most simply achieved by the stream of air itself, is advantageous. The liquor temperature should be from 10° to 40° C., preferably from 15° to 30° C.

The aeration steps must be taken directly after recovery, before rotting (leading to an unpleasant odor) occurs, and should be continued, if possible without lengthy interruption, until the liquor is reused. Interruption of the aeration (for example during transportation of the liquor) can be tolerated for 2–3 days, depending on the climatic conditions, provided the content of molecular oxygen in the liquor does not fall below 2 mg/l during this time.

Instead of air, oxygen can of course be blown in, but this offers no advantages.

Introducing oxygen by means of chemical oxygen carriers, such as peroxides, for example hydrogen peroxide, or oxidizing agents, for example permanganate, is not a suitable method, because this can interfere with the metabolic processes of the micro-organisms required for the process according to the invention, and may also damage the size (especially polyvinyl alcohol, PVA, and carboxymethylcellulose, CMC). In addition, the newly introduced pollutants, ie. the reduced oxidizing agents (for example manganese dioxide), lower the quality of the regenerated liquor.

If the oxygen content of the liquor drops below 2 mg/l before the start of aeration, or in the course thereof, there is a danger that (further) aeration will no longer prove successful in the sense of achieving the objects of the invention, ie. that the liquor will either no longer become odorless or will only do so after aeration for a length of time which is unacceptable in practice.

Inoculating the liquor with bacteria is as a rule not necessary. A small sample of desizing liquor, which has been treated according to the invention, from a preceding cycle (about 5%) however substantially accelerates the purification process in the course of the first 12 hours, so that adequate purification can be achieved after as little as 24 hours.

Suitable sizes for the process according to the invention are those which are difficult to biodegrade, ie. those in which, using the modified confirmatory test of W. Huber and K. H. Popp, Tenside Detergents 11 (1974), 195–197, the total organically bonded carbon of the size (total organic carbon = TOC) does not decrease by more than 20% and preferably by more than 10%. These are especially sizes based on polyacrylates, ie. copolymers of from 30 to 90% by weight of acrylic acid or methacrylic acid and from 10 to 70% by weight of acrylonitrile, with or without small amounts of acrylamide and acrylic acid esters of lower alcohols (such polyacrylates are described, for example, in German Published Applications DAS No. 1,594,905 and DAS No. 2,004,676, and German Laid-Open Applications DOS No. 2,714,897), as well as carboxymethylcellulose (CMC) having a degree of substitution (DS) of more than 0.5, ie. in which more than half of all primary hydroxyl groups are carboxymethylated, and sizes based on polyvinyl alcohol, which in the presence of concomitant fiber materials are surprisingly insensitive to oxidative degradation, even for long periods of aeration (about 8 days).

The sizes should be substantially free from corrosive salts, both to aid the sizing effect and to avoid corrosion of the apparatus. This is particularly important in the case of CMC, which often contains substantial amounts of sodium chloride from its process of preparation.

The aeration should be carried out for not less than 1–3 days at room temperature. In the presence of aerated regenerated liquor from a preceding cycle, 1–2 days suffices. The upper limit on the aeration time is only imposed by practical considerations (essentially the available storage area, the energy consumption for blowing-in air being negligible). The aeration time can therefore be varied within very wide limits to match the other operating conditions. The process of conversion of the dissolved impurities, to a solid substance which can sediment, initially takes place rapidly and then progressively slows down. The question of how long the aeration, and hence the purification, should and can be continued is a matter of practical considerations. As a rule, the liquor is reused after 3–8 days. The longer the aeration has been carried out, the longer it can be interrupted, under otherwise identical conditions, without causing damage to the liquor, ie. without the content of molecular oxygen dropping to below 2 mg/l. Accordingly, any lengthy transportation of the regenerated liquor is therefore more advantageously carried out at the end of the aeration time than at the beginning. However, even after lengthy aeration, the latter should not be interrupted for longer than is necessary.

The precipitate formed during aeration can be separated off in a conventional manner (by filtering, centrifuging or decanting). This gives a sizing liquor which is substantially (to the extent of about 50–90%, preferably 70–80%) free from impurities, is virtually odorless and can, depending on its concentration, be reused directly or after strengthening (by adding fresh size or removing water by evaporation or ultrafiltration); the properties of the liquor for practical purposes do not differ from those of a corresponding freshly made-up liquor.

It was not foreseeable that this very simple process would function at all, let alone that it would function so well, since the impurities removed greatly differ in nature and make up only a small fraction of the concentration of the size dissolved in the liquor. Furthermore, the dissolved size must not undergo significant modification during the treatment; yet a modification under these conditions had definitely to be expected, even in the case of sizes which are difficult to biodegrade, as, for example, experiments with polyvinyl alcohol, a material which biodegrades slowly, have shown (cf. Q. D. Wheatley and F. C. Baines, Textile Chemist and Colorist 8 (1976), 28). Used in combination with one of the modern simple processes for obtaining a relatively highly concentrated regenerated sizing liquor, for example as described in German Published Application DAS No. 2,543,815 or German Laid-Open Applications DOS No. 2,937,002, the present invention can very simply replace the very expensive process of ultrafiltration.

In the Examples, parts and percentages are by weight.

EXAMPLE 1

500 g of a cotton fabric, containing 6 percent by weight of a copolymer of 70 parts by weight of acrylic acid and 30 parts by weight of acrylonitrile which was prepared as described in Example 1d of German Published Application DAS No. 2,004,676, was neutralized with ammonia (to pH 7) and had a viscosity of 310 mPa.s, measured on a 10% strength aqueous solution at 20° C. and pH 7, were used for recovery of the polyacrylate size. The fabric referred to was cut into strips about 6 cm wide, which were sewn together end-to-end.

The resulting fabric tape was passed through a trough filled with water at 50° C. The residence time of the tape in the water was about 2 seconds. The fabric tape was then squeezed off between two rubber rollers (Shore hardness 80–85) under a pressure of 4 atmospheres. The tape travelled at about 6 cm/s and the residence time of the fabric from the moment of immersion to the moment of reaching the roll nip was about 8 s. The wet pick-up was about 140%. After a single pass of the fabric strip, 325 g of a 5% strength aqueous sizing liquor were collected. This corresponds to 16.2 g of size or 54% of the theoretically recoverable size.

The liquor obtained was concentrated to about 10% solids content by heating under reduced pressure from a waterpump. A carded cotton yarn of Nm 68/1 was sized with this regenerated liquor on a laboratory sizing machine, so as to apply 13 percent by weight of size solids.

The technical test data on the yarn, after conditioning for 24 hours at 21° C. and 70% relative atmospheric humidity, included the breaking load, elongation and the number of abrasion cycles to rupture. The means values from 20 individual determinations are shown in Table 1.

The abrasion number, a criterion of the sizing effect on staple fibers, was measured by the method of E. Keuk, Textil-Praxis, 7 (1952), 698, on a commercial yarn abrasion tester.

The breaking load and elongation at rupture were determined on a Statigraph N strength tester from Textechno Herbert Stein, Regentenstr. 37–39, Mönchengladbach, West Germany.

TABLE 1

| Size | Size weighting % | Abrasion number | Breaking load (g) | Elongation at rupture (%) |
|---|---|---|---|---|
| (a) Unsized | — | 62 | 120 | 6.7 |
| (b) Original size | 12.6 | 1554 | 236 | 5.6 |
| (c) Regenerated size, not treated according to the invention | 13.0 | 1369 | 232 | 5.7 |

The differences between measurements b and c are just outside the scatter of the methods of measurement in the case of the abrasion number, and within the scatter in the case of the other measurements. The results would suggest that after the first recovery cycle the weaving results would be identical. However, the literature (Trauter et al., Melliand Textilberichte 5 (1979), 379) discloses that the accumulation of lubricants, waxes, sizing fats or afterwaxing products beyond a certain limit, leads to a deterioration in weaving results. In principle, such accumulation occurs on each recovery cycle. The abrasion values given above show that the regenerated material gives a slightly poorer result than the original product. Evidently, this effect is attributable to the plasticizing effect of concomitant substances in the yarn, which are also responsible for an odor nuisance, due to biological degradation processes, on prolonged storage of the regenerated liquor, whereby reuse of the latter is made difficult or completely impossible.

Accordingly, the problem was to develop an economical, simple purification process which permits efficient removal of the interfering concomitant substances (fibers, waxes and lubricants) and prevents an odor nuisance on storage of the sizing liquor. The addition of size preservatives in fact does not provide a satisfactory solution to the odor problem (Table 2), or to the purification problem.

TABLE 2

| Storage of 10% strength regenerated sizing liquor | |
|---|---|
| Bactericidal additive | Time to rotting and mold formation |
| without | 2 days |
| 0.5% of 35% strength hydrogen peroxide | 10 days |
| 0.5% of dimethylol-dihydroxy-ethyleneurea | 6 days |
| 0.5% of 35% strength formaldehyde | 10 days |
| 0.2% of dimethyl-palmityl-benzyl-ammonium chloride | 5 days |
| 0.5% of phenol | 8 days |
| 0.5% of 1,2-benzisothiazolin-3-one | 8 days |

As will be seen, all the preservatives delay rotting, but do not solve the problem. A further increase in concentration of the preservatives is inadvisable, since the sizing effect may be adversely affected or—in the case of formaldehyde and its derivatives—crosslinking reactions with the size may occur. In addition, increased concentrations in some cases produce an unacceptable odor nuisance due to the bactericide itself (for example formaldehyde or phenol). In general, the addition of assistants to the regenerated sizing liquor is inadvisable, since these water-soluble components accumulate on repeated recycling and as a rule—even without such accumulation—interfere with the sizing effect or in some other way.

Surprisingly, the object of preventing rotting and at the same time removing undesired concomitant materials has been achieved by passing air into the regenerated liquor. For 3 days, sufficient air was blown through a glass tube into the regenerated liquor to achieve thorough mixing of the latter. The liquor temperature was 25° C. The treatment resulted in a precipitate which sedimented well and which was removed by means of separators. The dried precipitate amounted to 0.8% by weight of the liquor. When the regenerated liquor treated in this way was reused for sizing the cotton referred to at the outset, the results shown in Table 3 were obtained.

TABLE 3

| Size | Size weighting (%) | Abrasion number | Breaking load (g) | Elongation at rupture (%) |
|---|---|---|---|---|
| Untreated | — | 62 | 120 | 6.7 |
| Original size | 12.6 | 1554 | 236 | 5.6 |
| Regenerated liquor, treated with air | 12.0 | 1565 | 237 | 5.8 |

The results show that the treatment according to the invention has raised the quality of the regenerated liquor to that of the original size.

EXAMPLE 2

Warps for use in the polyester/cotton poplin coat fabric defined in more detail in Table 4 were treated with the following polyacrylate sizes:

Size A

The size consists of a copolymer of 65 percent by weight of acrylic acid and 35 percent by weight of acrylonitrile, in which copolymer 45 mole% of the acrylic acid groups were in the form of the calcium salt and 55 mole% in the form of the ammonium salt. The polymer was prepared by a method similar to Example 1 of German Published Application DAS 2,004,676 and had a viscosity of 250 mPa.s, measured in 15% strength aqueous solution in a Brookfield RVT viscometer at 100 rpm and 85° C.

Size B

A copolymer of 60 percent by weight of acrylic acid and 40 percent by weight of acrylonitrile, wherein 50 mole% of the acrylic acid groups were in the form of the calcium salt and the remainder in the form of the sodium salt. The polymer was prepared by a method similar to that used for size A. The viscosity was 320 mPa.s, under the same conditions of measurement as for size A.

Size C

Magnesium salt of a copolymer of 35 percent by weight of acrylic acid and 65 percent by weight of acrylonitrile, prepared by the method described in Example 1 of German Laid-Open Application DOS No. 2,714,897. Viscosity: 350 mPa.s.

The coating of polyacrylate size on the warp was, in all three cases, about 16% by weight of solids (based on dry untreated yarn). The warp was used for weaving on Rüti C looms at 70% relative humidity/21°–22° C., at the rate of 230 picks per minute (number of broken ends per loom per hour for A: 0.62, B: 0.54, C: 0.38).

TABLE 4

| Data of the poplin coat fabric | |
|---|---|
| Type of fiber | Polyester/cotton (65:35) |
| Warp density (ends/cm) | 49 |
| Filling density (picks/cm) | 25 |
| Warp yarn | Nm 50/1 |
| Filling yarn | Nm 51/1 |
| Total number of warp threads | 7580 |
| Construction | Linen 1/1 |

5,000 m of each of the poplin coat fabrics produced with sizes A, B and C respectively and carrying 10.5–11% of size were treated as described in Example 2 of German Laid-Open Application DOS No. 2,543,815, in order to recover the size. The recovery, in the case of all three sizes, was 80–85% of theory. Regenerated sizing liquors having a mean active ingredient concentration of 6% were obtained.

In order to be able to use these regenerated liquors again for sizing the warp of the above poplin fabric with about 16% of size, the concentration of the sizing liquor had to be raised to about 11%.

A commercial forced-circulation evaporator was used to concentrate the regenerated liquors of sizes A, B and C to a solids content of 12%, in order to compensate for the amount of condensate formed in the size boiler. Due to the effect of heat during drying and singeing of the fabric, and evaporating-down of the regenerated liquor, the pH dropped, in the case of size A, to 5.3 compared to a value of 6.5 in the original size, and this was corrected by means of 25% strength ammonia solution. In the case of sizes B and C, such correction proved unnecessary. The regenerated liquors, concentrated to 12% active ingredient content, were used in sizing and weaving experiments, both after standing for 5 days without treatment and after treatment according to the invention.

A comparison of the number of broken ends per loom hour shows that the treatment according to the invention improves the safe running of the weaving operation compared to the results with the untreated stored size, the result being of the same order as that achieved with the original size.

TABLE 5

| | Size A | Size B | Size C |
|---|---|---|---|
| Original | 0.62 | 0.54 | 0.38 |
| Untreated regenerated liquor | 0.80 | 0.76 | 0.56 |
| Regenerated liquor treated according to the invention | 0.59 | 0.57 | 0.40 |

EXAMPLE 3

In order to apply the process to other water-soluble staple fiber sizes such as polyvinyl alcohol and carboxymethylcellulose, the effect of the treatment with air on the COD (chemical oxygen demand) and on the pH, these being important criteria of a chemical change in the size, were investigated. In order to be able to regenerate and reuse a size several times, chemical changes in the size must be very slight.

About 6% strength solutions of the original sizes (Table 6), corresponding solutions with added sizing assistants (Table 7), and liquors containing cotton impurities or polyester/cotton (65:35) impurities (Table 8) were investigated. The impurities referred to were isolated by aqueous extraction of the corresponding yarns without addition of a wetting agent, this being a process which to a greater or lesser degree takes place on each recovery of a water-soluble size. Sedimented impurities were not separated off.

TABLE 6

| | Aeration without added assistant | | | | | |
|---|---|---|---|---|---|---|
| | Before treatment | | After 8 days | | Difference | |
| Size | pH | COD(3) | pH | COD | pH | COD |
| Size A | 6.8 | 1253 | 6.3 | 1217 | −0.1 | −2.9% |
| Size B | 6.3 | 1215 | 6.4 | 1194 | +0.1 | −1.7% |
| Size C | 6.3 | 1197 | 6.5 | 1173 | +0.2 | −2.0% |
| PVA(1) | 5.5 | 1794 | 7.6 | 994 | +2.1 | −44.6% |
| CMC, salt-free(2) | 5.7 | 958 | 6.5 | 914 | +0.8 | −4.6% |

(1)Degree of polymerization 1,400, degree of hydrolysis 88%
(2)Viscosity (4% strength, 20° C.): 60 mPa.s, measured by means of a Brookfield HAT viscometer, spindle No. 1, 20 rpm, degree of substitution DS = 0.7
(3)(mg of $O_2$/g of active ingredient)

TABLE 7

| | | Aeration with added assistant | | | | | |
|---|---|---|---|---|---|---|---|
| | | Before treatment | | After 8 days | | Difference | |
| Size | | pH | COD | pH | COD | pH | COD |
| A + 2% of fat | No.1 | 6.7 | 1259 | 6.6 | 1208 | −0.1 | −4.1% |
| A + 2% of fat | No.2 | 6.8 | 1284 | 6.7 | 1219 | −0.1 | −5.1% |
| A + 2% of fat | No.3 | 6.7 | 1305 | 6.6 | 1229 | −0.1 | −5.8% |
| PVA + 2% of fat | No.1 | 5.5 | 1774 | 6.3 | 1543 | +0.8 | −13.1% |
| PVA + 2% of fat | No.2 | 5.5 | 1748 | 8.0 | 1039 | +2.5 | −41.6% |
| PVA + 2% of fat | No.3 | 5.5 | 1840 | 6.2 | 1783 | +0.8 | −3.1% |
| CMC + 2% of fat | No.1 | 5.8 | 912 | 6.5 | 838 | +0.7 | −8.2% |
| CMC + 2% of fat | No.2 | 5.7 | 1034 | 4.6 | 814 | +1.9 | −21.3% |
| CMC + 2% of fat | No.3 | 5.7 | 1004 | 6.1 | 959 | +0.4 | −4.5% |

Chemical character of the sizing fats:
Grease No. 1
Non-liquid sizing fat (49–53° C.) based on a fatty acid triglyceride, plus emulsifier system based on $C_{13/15}$-oxo-alcohol-sulfonate and nonyl-phenol-oxyethylate.
Grease No. 2
Non-liquid sizing fat (46–48° C.) based on polyethylene glycol of mean molecular weight = 6,000, and stearic acid ester of a polyethylene glycol of molecular weight 1,000.
Grease No. 3
Stearic acid monoglyceride.

TABLE 8

| | Aeration in the presence of concomitant substances of cotton and polyester/cotton (PES/CO) yarns | | | | | |
|---|---|---|---|---|---|---|
| | Before treatment | | After 8 days | | Difference | |
| Size | pH | COD | pH | COD | pH | COD |
| A + 7.7% of cotton concomitants | 6.4 | 1278 | 6.8 | 1217 | −0.4 | −4.8% |
| PVAL + 7.6% of cotton concomitants | 5.5 | 1709 | 8.3 | 1503 | +2.8 | −12.1% |
| CMC + 7.7% of cotton concomitants | 5.6 | 965 | 8.9 | 753 | +3.3 | −12.0% |
| A + 3.2% of PES/CO concomitants | 6.3 | 1192 | 6.5 | 1155 | +0.2 | −3.2% |
| PVAL + 3.2% of PES/CO concomitants | 5.3 | 1734 | 7.9 | 1614 | +2.6 | −7.1% |
| CMC + 3.1% of PES/CO concomitants | 5.6 | 981 | 8.7 | 779 | +3.1 | −20.6% |

The data in Tables 6, 7 and 8 show that the effect of sizing assistants differs and follows no systematic pattern in relation to the size. The same is true of the effect of fiber concomitants. Polyacrylates are best suited to recycling, since their pH and chemical structure change only slightly under the very diverse influences of the concomitants, and this consequently ensures greatest reliability of weaving output. Provided sizing fats of type 2 are not present in the process according to the invention, polyvinyl alcohol and salt-free carboxymethylcellulose are also, with slight restrictions (for example CMC in the case of polyester/cotton, Table 8), amenable to the process. Surprisingly, polyvinyl alcohol, which on passing oxygen into the size degrades severely (Table 6), is substantially protected from oxidative degradation by certain sizing assistants or fiber concomitants.

We claim:

1. A process for purifying regenerated liquors of sizes which are difficult to biodegrade, which contain one or more of lubricants, sizing fats, waxes and pectins as impurities, wherein following the recovery of the size, aeration for microbiological treatment is employed to ensure that the content of molecular oxygen in the liquor does not drop below 2 mg/l, and the precipitate formed is separated off after not less than one day's aeration, and recovering the purified regenerated size liquor.

2. A process as claimed in claim 1, wherein the regenerated liquor employed is a liquor obtained by recovery of a polyacrylate size, a polyvinyl alcohol size or a carboxymethylcellulose size, the carboxymethylcellulose having a degree of substitution greater than 0.5.

3. The process of claim 2, wherein a polyacrylate size is recovered.

* * * * *